US008618897B2

(12) United States Patent
Gerving

(10) Patent No.: US 8,618,897 B2
(45) Date of Patent: Dec. 31, 2013

(54) SWITCHING DEVICE AND TERMINAL-SIDE ACCESSORIES

(75) Inventor: Karsten Gerving, Bonn (DE)

(73) Assignee: Eaton Electrical IP GmbH & Co. KG, Schoenefeld (DE)

( * ) Notice: Subject to any disclaimer, the term of this patent is extended or adjusted under 35 U.S.C. 154(b) by 0 days.

(21) Appl. No.: 13/821,268

(22) PCT Filed: Aug. 30, 2011

(86) PCT No.: PCT/EP2011/064910

§ 371 (c)(1),
(2), (4) Date: May 24, 2013

(87) PCT Pub. No.: WO2012/031946

PCT Pub. Date: Mar. 15, 2012

(65) Prior Publication Data

US 2013/0307650 A1 Nov. 21, 2013

(30) Foreign Application Priority Data

Sep. 8, 2010 (DE) ..... 20 2010 012 329 U

(51) Int. Cl.
*H01H 13/04* (2006.01)

(52) U.S. Cl.
USPC ..... 335/202; 335/132; 200/304; 200/305

(58) Field of Classification Search
USPC ..... 335/132, 202; 200/304, 305
See application file for complete search history.

(56) References Cited

U.S. PATENT DOCUMENTS 4,774,390 A 9/1988 Lehman et al.
6,144,001 A 11/2000 Green et al.

FOREIGN PATENT DOCUMENTS

CH 580342 A5 9/1976
DE 9011899 U1 10/1990
DE 29505046 U1 7/1996

*Primary Examiner* — Ramon Barrera
(74) *Attorney, Agent, or Firm* — Leydig, Voit & Mayer, Ltd.

(57) ABSTRACT

The invention relates to a switching device with a switching device housing, having first guiding and supporting recesses on the connecting side and at least one first detent cam that points away from the front face with a first detent surface. A protective cover which is designed as an accessory and which consists of two lateral protective walls and a front face protective wall that connects said lateral walls is equipped with at least one first detent hook, which points towards the front face protective wall with a second detent surface and which can be connected to the first detent cam, on the protective cover end face that points towards the switching device. A cable clamping block is equipped with second guiding and supporting formations that correspond to the first guiding and supporting formations and with at least one resiliently arranged third detent hook, which points towards the front face with a third detent surface and which can be connected to the first detent cam, on the cable clamping block rear wall that points towards the switching device. The cable clamping block is equipped with at least one second detent cam, the position and shape of which corresponds to the first detent cam and which can be connected to the first detent hook, on the front wall that points away from the switching device.

12 Claims, 5 Drawing Sheets

SWITCHING DEVICE AND TERMINAL-SIDE ACCESSORIES

CROSS REFERENCE TO RELATED APPLICATIONS

This application is a U.S. National Phase application under 35 U.S.C. §371 of International Application No. PCT/EP2011/064910, filed on Aug. 30, 2011, and claims benefit to German Patent Application No. DE 20 2010 012 329.1, filed on Sep. 8, 2010. The International Application was published in German on Mar. 15, 2012 as WO 2012/031946 A1 under PCT Article 21 (2).

FIELD

The invention relates to an electrical switching device for application in the low voltage range, particularly an electromagnetic switching device, with a switching device housing made of insulating material, with supply- and load-side cable terminals, accessible at oppositely situated terminal sides of the switching device housing, and accessories which can be joined at least indirectly to the switching device at the terminal sides if needed.

BACKGROUND

Document DE 90 11 899 U1 as nearest prior art discloses an electromagnetic switching device and terminal-side accessories. A cable clamp block in a moulded case is provided as an accessory which can be joined in a form-fitting fashion with the supply- or the load-side terminal side of the switching device housing. To this end, the terminal sides of the switching device housing each show two groove-like guide and retaining recesses with undercut sections running perpendicular to the front side of the switching device housing, which can be brought into engagement and joined with the cable clamp block by means of two matching guide and retaining mouldings. As a further accessory, a protective cover made of moulded material is provided for protection against contact with current-carrying parts. The protective cover consists of two lateral protective walls, a front protective wall joining them and intermediate separating ribs connected to it. The protective cover can optionally be mounted directly to the terminal side of the switching device housing or to the cable clamp block. For fastening to the switching device housing, the protective cover is provided with guide and retaining mouldings on one front face which match the guide and retaining mouldings of the cable clamp block in position and shape and can be brought into engagement and joined with the guide and retaining recesses of the switching device housing. For fastening the protective cover to the cable clamp block, it has two lateral guide and retaining rails running perpendicular to the front side which can be brought into engagement and joined with matching guide and retaining recesses on the protective cover. The protective cover can be locked in a defined position by means of a locking hook formed in the protective cover. For adjusting the length of the protective cover to particular requirements, the protective cover exhibits parting lines running crosswise to the longitudinal direction of the cables.

By contrast, in the circuit breaker according to document DE 295 05 046 U1, a cable clamp block is screwed to the switching device housing. In attaching a protective cover to the cable clamp block, pairs of ledges provided on it, terminal-side grooves and outward-pointing L-shaped indentations cooperate with corresponding pairs of slots constructed on the front face of the protective cover and clamp ribs on the face and lateral, inward pointing retaining webs. Direct assembly of the protective cover to the switching device housing is not provided for.

SUMMARY

In an embodiment, the present invention provides an assembly including an electrical switching device having an electrical switching device housing made of moulded material and terminal-side accessories. The switching device housing includes a front side and oppositely situated terminal sides that respectively include supply-side cable terminals and load-side cable terminals. The switching device housing includes first groove-shaped, undercut guide and retaining recesses disposed on a terminal side running perpendicular to the front side of the housing and at least one first snap cam with a first locking surface facing away from the front side. A protective cover forms a first of the terminal-side accessories and includes two lateral protective walls and a front-side protective wall connecting the lateral protective walls. The protective cover also includes a front face that faces the switching device. The front face includes first guide and retaining mouldings configured to be brought into undercut engagement and joined in form-fitting fashion to the first guide and retaining recesses of the switching device housing, and at least one elastically installed first locking hook with a second locking surface facing the front-side protective wall. The first locking hook is configured to be joined to the at least one first snap cam. A cable clamp block forms a second of the terminal-side accessories. The cable clamp block including a back wall that faces the switching device and a front wall that faces away from the switching device. The back wall includes second guide and retaining mouldings having a matching position and shape as the first guide and retaining mouldings. The second guide and retaining mouldings are configured to be brought into undercut engagement and joined in form-fitting fashion with the first guide and retaining recesses of the switching device housing. The back wall also includes at least one elastically installed third locking hook with a third locking surface facing the front side and configured to be joined to the at least one first snap cam. The front wall includes second guide and retaining recesses having a matching position and shape as the first guide and retaining recesses. The second guide and retaining recesses are configured to be brought into undercut engagement and joined in form-fitting fashion with the first guide and retaining mouldings. The front wall also includes at least one second snap cam having a matching position and shape as the first snap cam and configured to be brought into engagement with the first locking hook.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
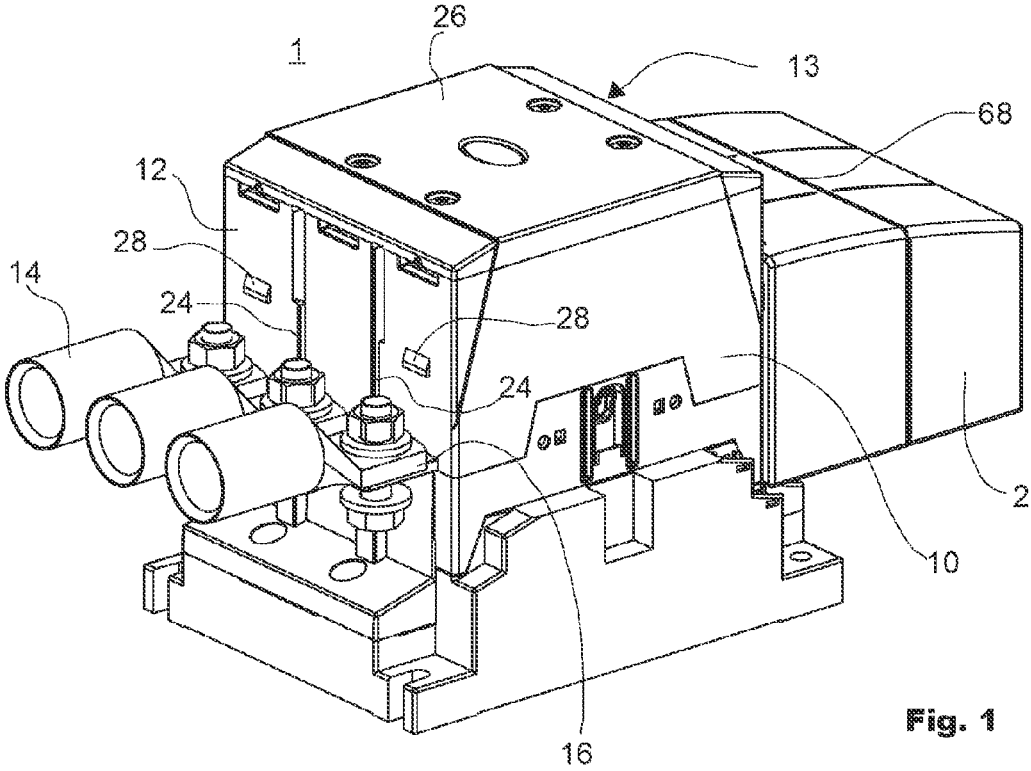
FIG. 1 shows a switching device on a terminal side with and without terminal-side accessories on the opposite terminal side.

In an embodiment, the present invention provides a simplified construction, with respect to manufacture and handling, of a switching device with terminal-side accessories.

Beginning with a switching device and terminal-side accessories of the type initially mentioned, the task is solved according to the invention by the features of the independent claim, while advantageous further developments of the invention are to be inferred from the dependent claims.

By means of guide and retaining recesses and snap cams formed on the switching device housing, by means of first guide and retaining mouldings and locking hooks formed on a protective cover, by means of second guide and retaining mouldings, resembling the first guide and retaining mouldings, formed on a cable clamp block as well as third locking hooks resembling the first locking hooks, on the one hand, and second guide and retaining recesses resembling the first guide and retaining recesses as well as second snap cams resembling the first snap cams, on the other hand, the combination of the switching device with the terminal-side accessories is accomplished simply and in accordance with the respective requirements. The switching device can be equipped on one terminal side or both terminal sides with a protective cover only, with a cable clamp block only, with a cable clamp block together with a protective cover, or without any of these accessories. For accomplishing the various combinations mentioned, only similar type connecting elements are provided, and no special instructions have to be followed.

For fitting to different cable diameters it is advantageous to mount the protective cover at different distances from the front face, to which end a suitable second locking hook is provided, in addition to at least one locking hook, and offset with respect to it.

Suited to this purpose are paired guide and retaining recesses and guide and retaining mouldings and snap cams, as well as locking hooks.

It is advantageous to position a locking hook on a spring shackle elastically spaced away from the front protective wall.

For easy and secure mounting of the terminal-side accessories, it is advantageous and appropriate if the guide and retaining recesses open toward the front face, and if the guide and retaining recesses as well as the guide and retaining mouldings are constructed at least partially with an L-shaped cross-section.

A further advantage with regard to matching to the respective conditions occurs with hat-shaped finger guard caps, which can be inserted into clamping bars next to the entrance openings for the cable terminals on the cable clamp block and can be retained by the second, and if necessary by additional snap cams. Another advantage here is the grid-like, pierceable if necessary, cover surface of the finger guard caps.

For better separation of the connecting cables it is appropriate to provide the protective cover with separating ribs. For suitable matching to the connection conditions, for example to the length of the cable lugs connected to the connecting cables, it is also appropriate to make it possible to cut the protective cover to length by means of at least one parting line.

An advantageous feature consists of equipping the cable clamp block with breakout openings which, in case of need, allow access to auxiliary conductor connections for connecting auxiliary conductors, particularly for control or status signals.

Figure 2:
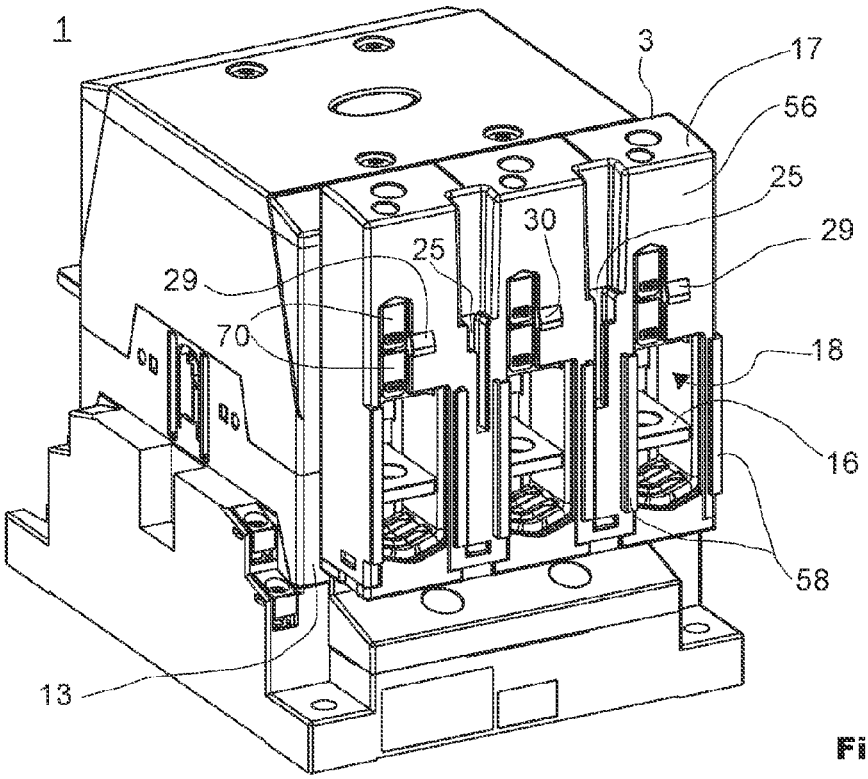
FIG. 2 shows the switching device with cable clamp block.
Figure 3:
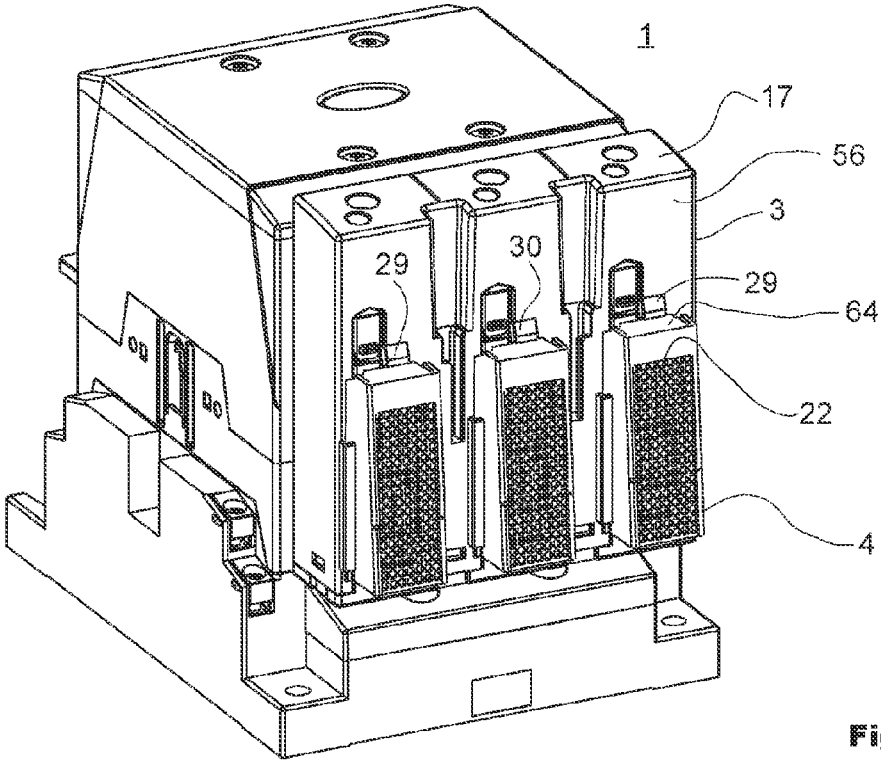
FIG. 3 shows the switching device with cable clamp block and finger guard caps.
Figure 4:
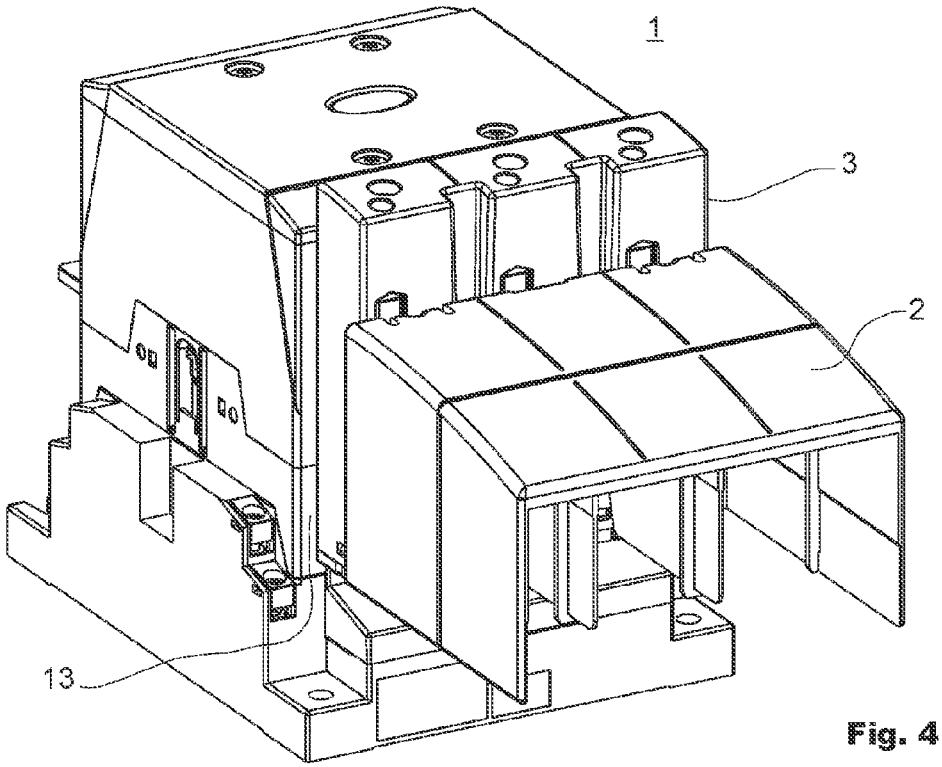
FIG. 4 shows the switching device with cable clamp block and protective cover.

FIG. 1 through FIG. 4 show the different and advantageous combinations of a switching device 1, taking in example the form of a three-pole electromagnetic switching device, with its terminal-side accessories according to the invention. FIG. 1 shows the switching device 1 enveloped by a switching device housing 10 made of moulded insulating material on its supply-side terminal side 12 without any accessories according to the invention. The connecting cables represented by cable lugs 14 are screwed to the cable terminals 16 of the switching device 1. A protective cover 2 made of moulded insulating material is mounted in front of the load-side terminal side 13 of the switching device 1, thereby providing extensive protection from contact with current-carrying metal parts. FIG. 2 shows the switching device 1 in combination with a cable clamp block 3 mounted in front of the terminal side 13 with case 17 made of moulded insulating material. Here it is possible to connect connecting cables to the cable terminals 16 accessible through access openings 18 in the moulded material case 17. FIG. 3 shows similarly to FIG. 2 a combination of the switching device 1 with the cable clamp block 3, but this time the access openings 18 are protected against contact by finger guard caps 4. The finger guard caps 4 are shown in the new condition and can be suitably pierced through their grid-like cover surface 22 for the purpose of feeding cable ends through. FIG. 4 shows a combination of the switching device 1 with protective cover 2 and cable clamp block 3. The cable clamp block 3 is mounted in front of the terminal side 13 of the switching device 1, and the protective cover 2 is mounted in front of the access openings 18 of the cable clamp block. This combination allows the connection of connecting cables through the cable clamp block 3, as well as an extensive contact protection against current-carrying parts.

Figure 5:
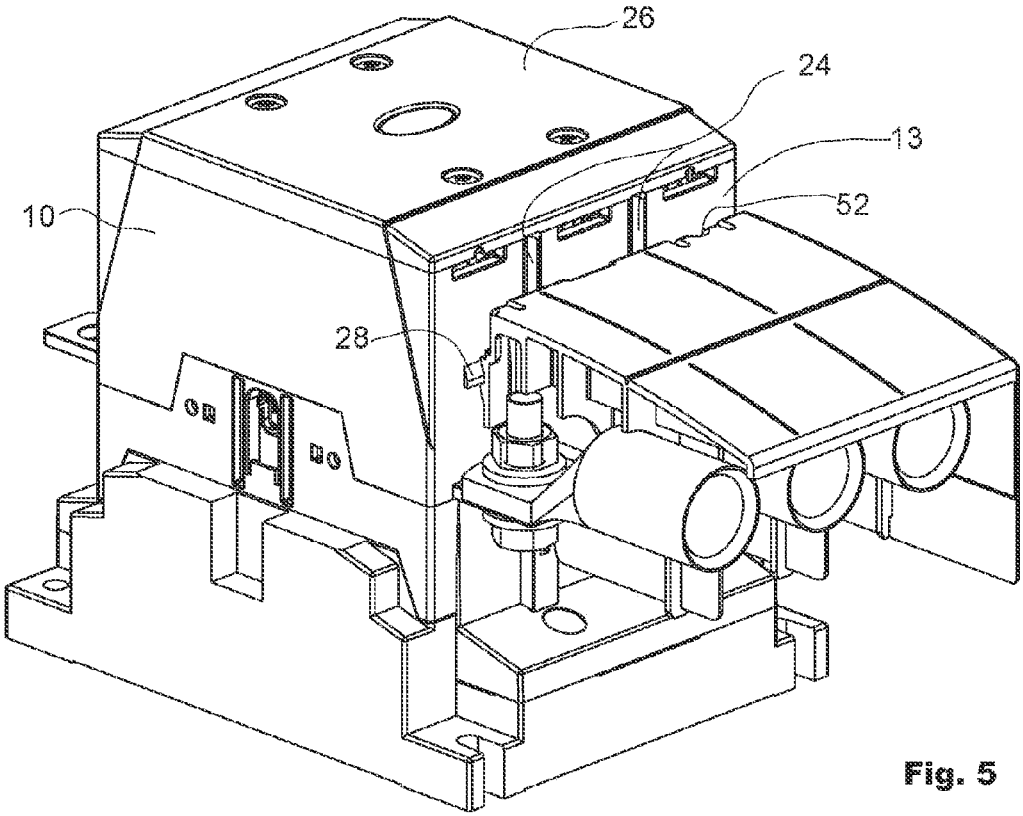
FIG. 5 shows the switching device with protective cover in partial cutaway view.
Figure 6:
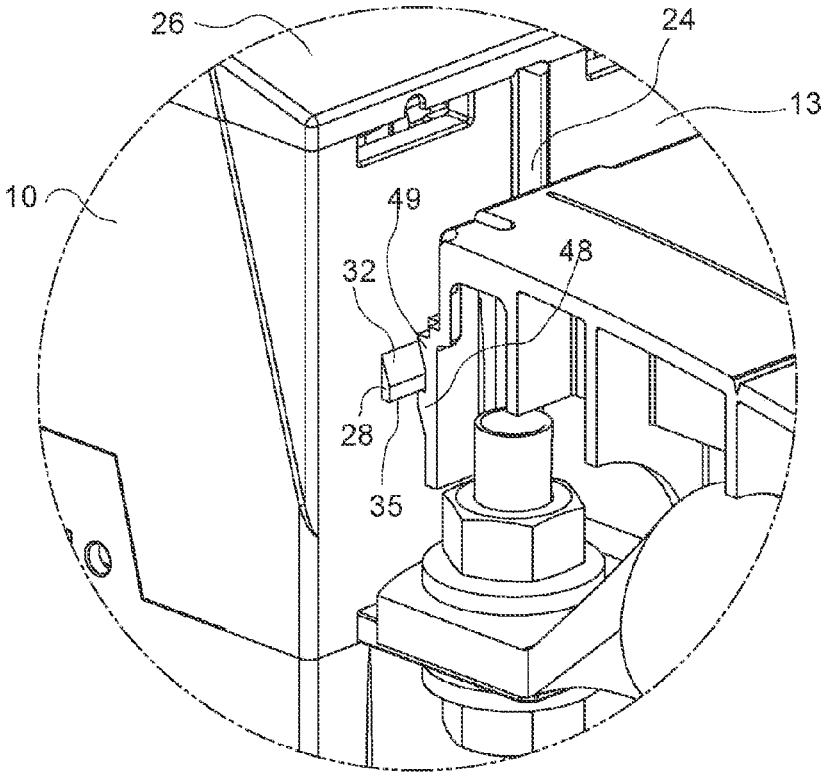
FIG. 6 shows a detail from FIG. 5.

As shown in FIG. 1, FIG. 5 and FIG. 6, one pair of first guide and retaining recesses 24 is shown on each of the terminal sides 12 and 13 of the switching device housing 10. The groove-shaped guide and retaining recesses 24 run perpendicular to the front face 26 of the switching device 1, open toward the front face 26 and are constructed, in their area that is remote from the front face 26, undercut with an L-shaped cross-section. In addition, pairs of first locking cams 28 stand out from the terminal sides 12, 13, having first inclined slides 32 pointing toward the front face 26 and running with a first locking surface 35 parallel to and turned away from the front face 26.

Figure 7:
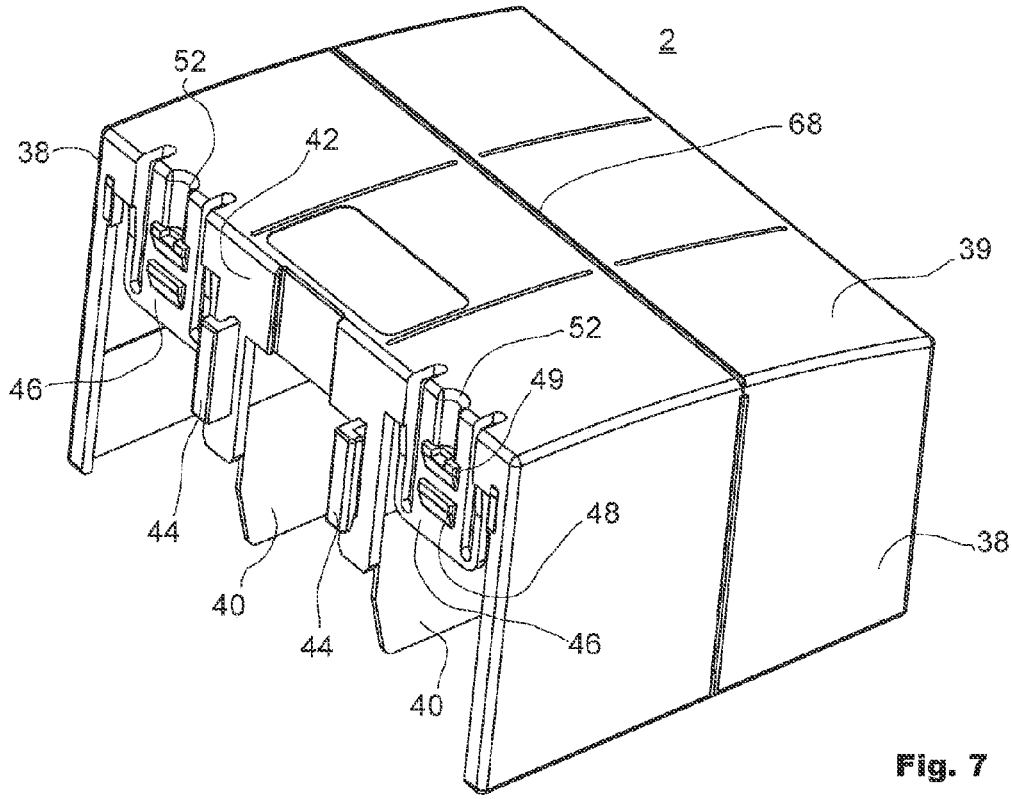
FIG. 7 shows the protective cover in partial device-side perspective.

As shown in FIG. 7, the protective cover 2 consists of two outer lateral protective walls 38 and a front-side protective wall 39 connecting the two. Inner separating ribs 40 parallel to the lateral protective walls 38 stand out from the protective wall 39, separating the connecting cables according to pole. According to FIG. 7 and FIG. 8, the protective cover 2 exhibits, on its front face 42 to be joined to the terminal side 12 or 13 of the switching device 1, a pair of batten-shaped first guide and retaining mouldings 44. On the front face, a pair of first spring shackles 46 is formed from the front-side protective wall 39. The first spring shackles 46 are elastically bendable parallel to the protective walls 38 and 39. On each spring shackle respectively are formed a first locking hook 46 and a second locking hook 49. The locking hooks 48, 49 are similarly constructed and point away from the front-side protective wall 39 with second diagonal slides 33 and run with second locking surfaces 36 parallel to the front-side protective wall 39. The locking hooks 48, 49 are positioned one behind the other on each first spring shackle 46 respectively in the direction of the front-side protective wall 39, whereby the second locking hook 49 is located closer to the front-side protective wall 39.

Upon setting the protective cover 2 on the corresponding terminal side 12 or 13 of the switching device 1, the first guide and retaining mouldings 44 engage in the first guide and retaining recesses 24 of the switching device housing 10 and thereby create an undercut connection. In the process, as shown in FIG. 5 through FIG. 8, the diagonal slides 32 of the first snap cams 28 slide over the diagonal slides 33 of the first locking hooks 48, whereafter the protective cover 2 is locked in a first position by laying the locking surfaces 35 of the first snap cams 28 on the locking surfaces 36 of the first locking hooks 48. If a mounting position located farther from the front side 26 compared with FIG. 5 is desired, then it can be arranged, by the use of greater force on the protective cover 2, that the diagonal slides 32 of the first snap cams slide farther over the diagonal slides 33 of the second locking hooks 49, whereafter the protective cover 2 is locked in a second position by laying the locking surfaces 35 of the first snap cams 28 on the locking surfaces 36 of the second locking hooks 49. The locking surfaces 35, 36 can be taken out of engagement, and the protective cover 2 thereby released from the switching element housing 10, by means of a suitable tool through the first half-openings 52 left free at the junction of the front-side protective wall 39 and first spring shackles 46.

Figure 8:
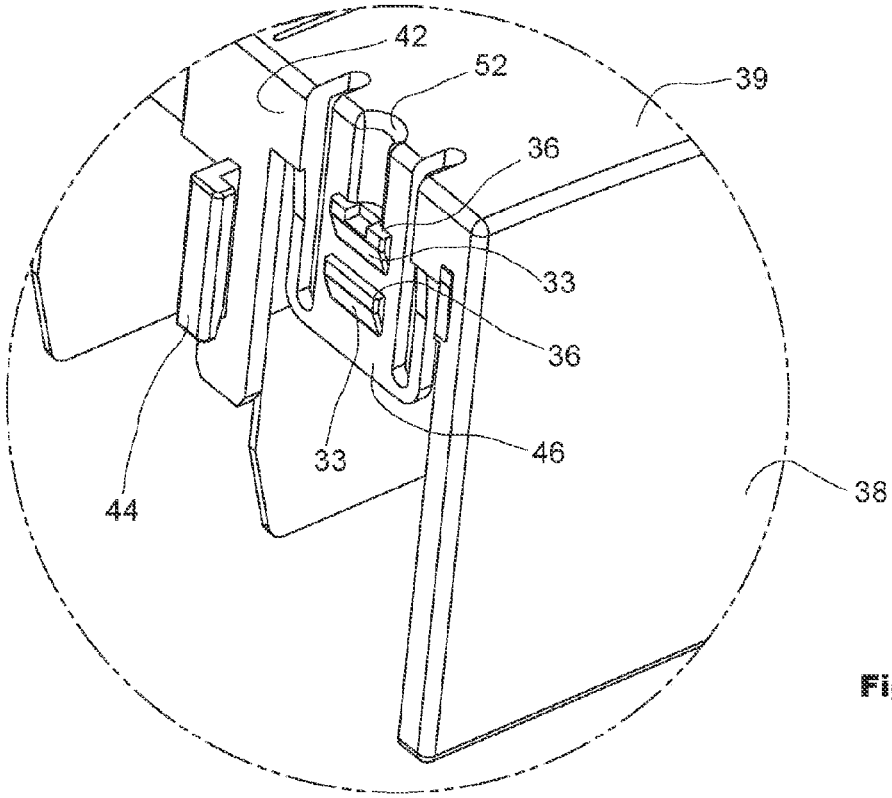
FIG. 8 shows a detail from FIG. 7.
Figure 9:
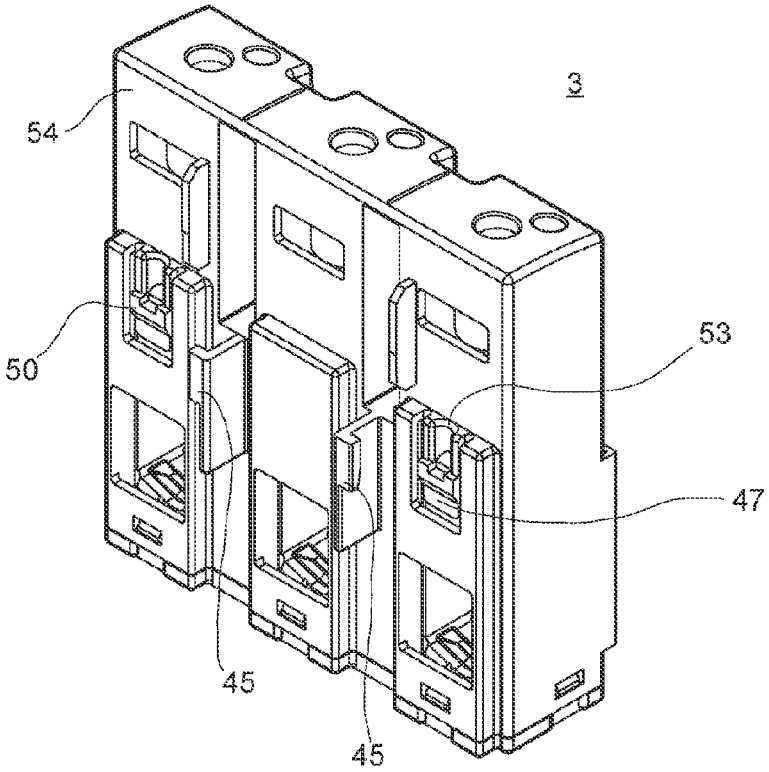
FIG. 9 shows the cable clamp block in partial device-side perspective.
Figure 10:
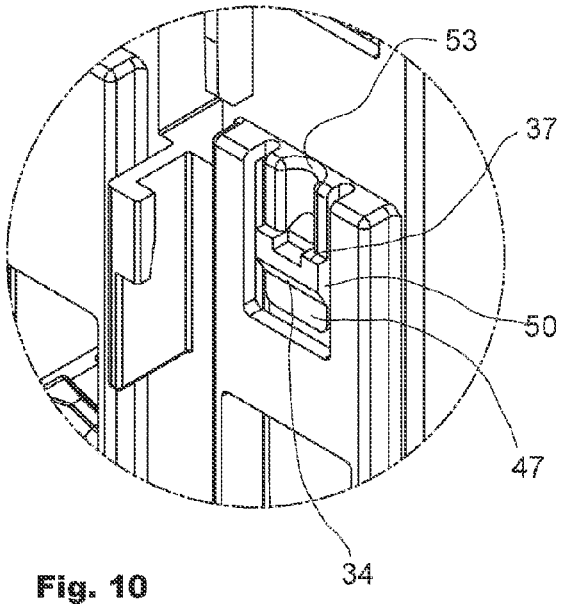
FIG. 10 shows a detail from FIG. 9.

As shown in FIG. 9 and FIG. 10, the cable clamp block 3 is equipped with a pair of batten-shaped guide and retaining mouldings 45 on its back wall 54 facing the switching device 1, which match the first guide and retaining mouldings 44 of the protective cover 2 (FIG. 7) and are partially L-shaped in construction. Furthermore, a pair of second spring shackles 47 is provided on the back wall 54, each bearing one third locking hook 50. The third locking hook 50 match in arrangement and shape, particularly with respect to a third diagonal slide 34 and a third locking surface 47, the second locking hook 49 of the protective cover 2 (FIG. 8).

In setting the cable clamp block 3 on the corresponding terminal side 12 or 13 of the switching device 1, the second guide and retaining mouldings 45 engage in the first guide and retaining recesses 24 of the switching device housing 10 and thereby create an undercut connection. In the process, the diagonal slides 32 of the first snap cams 28 slide over the diagonal slides 34 of the third locking hooks 50, whereafter the cable clamp block 3 is locked by laying the locking surfaces 35 of the first snap cam 28 on the locking surfaces 37 of the third locking hook 50. The locking surfaces 35, 37 can be taken out of engagement, and the cable clamp block 3 thereby released from the switching element housing 10, by means of a suitable tool through the second half-openings 53 left free at the junction of the back wall 54 and second spring shackles 47.

As shown in FIG. 2, the cable clamp block 3 is equipped with a pair of groove-shaped second guide and retaining recesses 25 on its front wall 56 facing away from the switching device 1, which correspond in arrangement and shape the first guide and retaining recesses 24 of the switching device 1. Furthermore, a pair of second snap cams 29 is provided on the front wall 56, which are arranged in front of the two outer access openings 18. The second snap cams 29 are similar in arrangement and shape to the first snap cams 28 on the switching device 1 (FIG. 1).

In setting the protective cover 2 on the front wall 56 of the cable clamp block 3, the first guide and retaining mouldings 44 of the protective cover 2 engage in the second guide and retaining recesses 25 and thereby create an undercut connection. In the process the second snap cams 29 cooperate in the manner already described with the first and second locking hooks 48 and 49 respectively of the protective cover.

Figure 11:
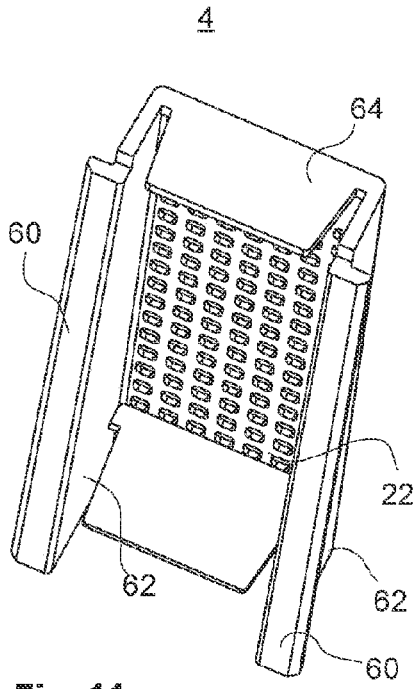
FIG. 11 shows a finger guard cap in device-side perspective.

As shown in FIG. 2 and FIG. 3, a pair of L-shaped clamping bars 58 is formed on the front wall 56 of the cable clamp block 3 on either side next to each access opening 18. Furthermore, an additional snap cam 30 similar to the second snap cam 29 is provided in front of the middle access opening 18. As shown in FIGS. 3 and 11, the finger guard caps 4 are built box-shaped with an open side located opposite the grid-like cover surface 22, and with elastic sidewalls when the profile is hat-shaped. The finger guard caps 4 can be clamped behind the clamping bars 58 by means of the brim-like circumferential surfaces 60 of the elastic longitudinal sides 62. At the same time, the finger guard caps 4 are set in their position on the cable clamp block 3 at their respective front transverse side 64 by means of the snap cams 29, 30. The cover surfaces 22 are only pierced to the extent that the ends of the cables to be connected need to pass through, whereby an extensive protection is afforded against dangerous contact with energised parts.

As shown in FIG. 7, the protective cover 2 is provided parallel to its front face 42 with a parting line 68 extending through the sidewalls 38, 39. With the help of the parting line 68, the protective cover 2 can be shortened so as to suitably match the cables to be connected.

FIG. 2 shows that the cable clamp block 3 is equipped with breakout openings 70 for auxiliary conductor terminals located behind them on its front wall 56 facing away from the switching device 1. By breaking away the breakout openings 70, access to the auxiliary conductor terminals is opened for connecting auxiliary conductors, particularly for control or status signals. One pair of breakout openings 70 per pole is provided next to each second snap cam 29. By this means, auxiliary conductors can be connected as necessary above and/or below to the auxiliary conductor terminals.

In the illustrations, only the load-side terminal side 13 of the switching device 1 is shown in combination with the terminal-side accessories 2, 3, 4. It is obvious that either the supply-side terminal side 12 alone or both terminal sides 12, 13 are or can be combined in the same or a different manner with the terminal-side accessories.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B." Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise.

LIST OF REFERENCE SYMBOLS

1 Switching device
2 Protective cover
3 Cable clamp block
4 Finger guard cap
10 Switching device housing
12; 13 Terminal side
14 Cable lugs
16 Cable terminals
17 Moulded housing
18 Access openings
22 Cover surface
24; 25 Guide and retaining recesses
26 Front side
28; 29; 30 Snap cams
32; 33; 34 Diagonal slides
35; 36; 37 Locking surface
38; 39 Protective walls
40 Separating ribs
42 Front face
44; 45 Guide and retaining mouldings
46; 47 Spring shackles
48; 49; 50 Locking hook
52; 53 Half-openings
54 Back wall
56 Front wall
58 Clamping bars
60 Circumferential surfaces
62 Longitudinal sides
64 Transverse side
68 Parting line
70 Breakout openings

The invention claimed is:

1. An assembly including an electrical switching device including an electrical switching device housing made of moulded material and terminal-side accessories, the assembly comprising:

the switching device housing including a front side and oppositely situated terminal sides respectively including supply-side cable terminals and load-side cable terminals, the switching device housing including first groove-shaped, undercut guide and retaining recesses disposed on a terminal side running perpendicular to the front side of the housing and at least one first snap cam with a first locking surface facing away from the front side;

a protective cover forming a first of the terminal-side accessories, the protective cover including two lateral protective walls and a front-side protective wall connecting the lateral protective walls, the protective cover including a front face that faces the switching device, the front face including:

first guide and retaining mouldings configured to be brought into undercut engagement and joined in form-fitting fashion to the first guide and retaining recesses of the switching device housing, and at least one elastically installed first locking hook with a second locking surface facing the front-side protective wall, the first locking hook being configured to be joined to the at least one first snap cam; and a cable clamp block forming a second of the terminal-side accessories, the cable clamp block including a back wall that faces the switching device and a front wall that faces away from the switching device, the back wall including:

second guide and retaining mouldings having a matching position and shape as the first guide and retaining mouldings, the second guide and retaining mouldings being configured to be brought into undercut engagement and joined in form-fitting fashion with the first guide and retaining recesses of the switching device housing, and at least one elastically installed third locking hook with a third locking surface facing the front side and configured to be joined to the at least one first snap cam, and the front wall including:

second guide and retaining recesses having a matching position and shape as the first guide and retaining recesses, the second guide and retaining recesses being configured to be brought into undercut engagement and joined in form-fitting fashion with the first guide and retaining mouldings, and at least one second snap cam having a matching position and shape as the first snap earn and configured to be brought into engagement with the first locking hook.

2. The assembly according to claim 1, wherein the switching device is an electromagnetic switching device.

3. The assembly according to claim 1, wherein at least one second locking hook is disposed on the protective cover and is matching in form and function with the first locking hook, the at least one second locking hook being positioned offset with respect to the first locking hook in a direction toward the front-side protective wall.

4. The assembly according to claim 1, wherein the first and the second guide and retaining recesses as well as the first and second guide and retaining mouldings are configured in pairs.

5. The assembly according to claim 1, wherein the first and the second snap cams as well as the locking hooks are configured in pairs.

6. The assembly according to claim 1, wherein the at least one locking hook is disposed on an elastically outstanding spring shackle.

7. The assembly according to claim 1, wherein the guide and retaining recesses open toward the front side and the guide and retaining mouldings are constructed at least partially with an L-shaped cross-section.

8. The assembly according to claim 1, further comprising box shaped finger guard caps equipped with brim-like circumferential surfaces configured as additional accessories, wherein the front wall of the cable clamp block includes L-shaped clamp bars formed in pairs and running perpendicular to the front side beside terminal-side access openings, the L-shaped clamp bars being configured to be brought into undercut and clamping connection with the circumferential surfaces and, wherein the second snap cam is positioned in a direction of the front side beside the access openings and the finger guard caps are positioned inserted into the latter.

9. The assembly according to claim 8, wherein cover surfaces of the finger guard caps extend substantially parallel to the front wall of the cable block and are of grid-like construction and capable of being pierced.

10. The assembly according to claim 1, wherein separating ribs running parallel to the lateral protective walls protrude from the front-side protective wall of the protective cover.

11. The assembly according to claim 1, wherein the protective cover includes at least one parting line running parallel to the front face.

12. The assembly according to claim 1, wherein the cable clamp block includes breakout openings for auxiliary conductor terminals lying behind them on its front wall facing away from the switching device.

* * * * *